US005679062A

United States Patent [19]

Goenka

[11] Patent Number: 5,679,062

[45] Date of Patent: Oct. 21, 1997

[54] $CO_2$ CLEANING NOZZLE AND METHOD WITH ENHANCED MIXING ZONES

[75] Inventor: Lakhi Nandlal Goenka, Ann Arbor, Mich.

[73] Assignee: Ford Motor Company, Dearborn, Mich.

[21] Appl. No.: 436,048

[22] Filed: May 5, 1995

[51] Int. Cl.[6] ..... B24C 3/00

[52] U.S. Cl. ..... 451/75; 451/102

[58] Field of Search ..... 451/75, 102, 39, 451/53, 439, 410, 319, 320, 321, 322; 239/590.3, 590.5

[56] References Cited

U.S. PATENT DOCUMENTS

| | | | |
|---|---|---|---|
| H1379 | 12/1994 | Meuer | 451/102 |
| 1,941,726 | 1/1934 | Vawter | 239/590.3 |
| 3,676,963 | 7/1972 | Rice et al. . | |
| 3,878,978 | 4/1975 | Martinek . | |
| 4,038,786 | 8/1977 | Fong . | |
| 4,389,820 | 6/1983 | Fong et al. . | |
| 4,415,107 | 11/1983 | Palmieri . | |
| 4,519,812 | 5/1985 | Brull et al. . | |
| 4,545,155 | 10/1985 | Nakata . | |
| 4,631,250 | 12/1986 | Hayashi . | |
| 4,747,421 | 5/1988 | Hayashi . | |
| 4,806,171 | 2/1989 | Whitlock et al. . | |
| 4,828,184 | 5/1989 | Gardner et al. . | |
| 4,932,168 | 6/1990 | Tada et al. . | |
| 4,962,891 | 10/1990 | Layden . | |
| 5,018,667 | 5/1991 | Lloyd . | |
| 5,025,597 | 6/1991 | Tada et al. . | |
| 5,050,805 | 9/1991 | Lloyd et al. . | |
| 5,074,083 | 12/1991 | Kanno et al. . | |
| 5,111,984 | 5/1992 | Niedbala . | |
| 5,283,990 | 2/1994 | Shank, Jr. | 451/102 |
| 5,294,261 | 3/1994 | McDermott et al. . | |
| 5,390,450 | 2/1995 | Goenka . | |
| 5,405,283 | 4/1995 | Goenka . | |

OTHER PUBLICATIONS

Elements of Gas Dynamics by Liepmann & Roshko, 1957, Chapter 5, Flow in Ducts and Wind Tunnels, pp. 124–125.

$CO_2$ Development Program, Final Test Report, Contract F09603-90-G-0016-Q601, Mod 3, Document No. Q603-92038-F1, 26 Sep. 1992, prepared by Mercer University, Mercer Engineering Research Center.

*Primary Examiner*—James G. Smith
*Assistant Examiner*—Derris H. Banks
*Attorney, Agent, or Firm*—Richard D. Dixon

[57] ABSTRACT

An apparatus and method for cleaning a workpiece with abrasive $CO_2$ snow operates with a nozzle for creating and expelling the snow. The nozzle includes an upstream section defined by a first contour for receiving $CO_2$ in a gaseous form. The nozzle also includes a downstream section for directing the flow of the $CO_2$ and the snow toward the workpiece, with the downstream section having a second contour optimized for supersonic flow of the $CO_2$. The nozzle includes a throat section, interposed between the upstream and downstream sections, for changing the $CO_2$ from the gaseous phase to an intermediate mixture of $CO_2$ gas, liquid and snow within the downstream section at a speed of at least Mach 1.1. A turbulence cavity section is interposed between the throat section and the downstream section for inducing both turbulence within the $CO_2$ gas flowing therethrough, thereby increasing the nucleation and agglomeration of the $CO_2$ within a snow zone defined within the downstream section. The throat, upstream, turbulence cavity and downstream sections of the nozzle may be manufactured from silicon micromachined surfaces.

20 Claims, 2 Drawing Sheets

$CO_2$ CLEANING NOZZLE AND METHOD WITH ENHANCED MIXING ZONES

FIELD OF THE INVENTION

The present invention relates to an apparatus and method for creating abrasive $CO_2$ snow at supersonic speeds and for focusing the snow on contaminants to be removed from a workpiece.

BACKGROUND OF THE INVENTION

The use of liquid carbon dioxide for producing $CO_2$ snow and subsequently accelerating it to high speeds for cleaning minute particles from a substrate is taught by Layden in U.S. Pat. No. 4,962,891. A saturated $CO_2$ liquid having an entropy below 135 BTU per pound is passed though a nozzle for creating, through adiabatic expansion, a mix of gas and the $CO_2$ snow. A series of chambers and plates are used to improve the formation and control of larger droplets of liquid $CO_2$ that are then converted through adiabatic expansion to the $CO_2$ snow. The walls of the ejection nozzle for the $CO_2$ snow are suitably tapered at an angle of divergence of about 4 to 8 degrees, but this angle is always held below 15 degrees so that the intensity of the stream of the solid/gas $CO_2$ will not be reduced below that which is necessary to clean the workpiece. The nozzle may be manufactured of fused silica, quartz or some other similar material.

However, this apparatus and process, like other prior art technologies, utilize a Bernoulli process that involves incompressible gasses or liquids that are forced through a nozzle to expand and change state to snow or to solid pellets. Also, the output nozzle functions as a diffusion promoting device that actually reduces the exit flow rate by forming eddy currents near the nozzle walls. This mechanism reduces the energy and the uniformity of the snow distributed within the exit fluid, which normally includes liquids and gasses as well as the solid snow.

Some references, such as Lloyd in U.S. Pat. No. 5,018,667, teach the use of multiple nozzles and tapered orifices in order to increase the turbulence in the flow of the $CO_2$ and snow mixture. These references seek to disperse the snow rather than to focus it after exiting the exhaust nozzle. Lloyd teaches that the snow should be created at about one-half of the way through the nozzle in order to prevent a clogging or "snowing" of the nozzle. While Lloyd recognizes that the pressure drop in a particular orifice is a function of the inlet pressure, the outlet pressure, the orifice diameter and the orifice length, his major concern was defining the optimum aspect ratio, or the ratio of the length of an orifice to the diameter of the orifice, in order to prevent the "snowing" of the orifice.

In all of these references, additional energy must be provided to accelerate the snow to the desired exit speed from the nozzle when the snow is not created in the area of the exhaust nozzle.

The inventor in the present case has addressed many of these problems with the $CO_2$ cleaning nozzle described in copending application Ser. No. 08/043,943 entitled Silicon Micromachined $CO_2$ Cleaning Nozzle and Method. Other non-related $CO_2$ cleaning inventions have been disclosed by the inventor in U.S. Pat. No. 5,390,450 and related applications presently pending.

It is an object of the present invention to create the $CO_2$ snow at a location downstream of the throat in the nozzle such that the supersonic speed of the $CO_2$ will be transferred to the snow, while simultaneously focusing the snow and the exhaust gas into a fine stream that can be used for fineline cleaning applications.

A primary object of the present invention is to employ a mid-stream turbulence cavity which is shaped to precipitate additional solid $CO_2$ snow particles by enhancing the turbulent agglomeration or nucleation of smaller $CO_2$ solid and liquid particles within the cavity.

SUMMARY OF THE INVENTION

An apparatus and method for cleaning a workpiece with abrasive $CO_2$ snow operates with a nozzle for creating and expelling the snow. The nozzle includes an upstream section for receiving $CO_2$ in a gaseous form at a first pressure, and having a first contour optimized for subsonic flow of the $CO_2$. The nozzle also includes a downstream section for directing the flow of the $CO_2$ gas and snow toward the workpiece, with the downstream section having a second contour optimized for supersonic flow of the $CO_2$. The nozzle includes a narrow throat section, interposed between the upstream and downstream sections, for changing at least a portion of the $CO_2$ from the gaseous phase to a gas, liquid and snow mixture within the downstream section at a speed of at least Mach 1.1. Maximum kinetic energy is imparted to the $CO_2$ snow by delaying the conversion into the solid phase until the gaseous $CO_2$ reaches supersonic speeds in the downstream section of the nozzle.

A turbulence cavity is interposed between the upstream and downstream sections of the nozzle, preferably located adjacent to and downstream from the narrowed throat section. The turbulence cavity expands from the relatively narrow section of the throat section in order to introduce additional mid-stream turbulence in the $CO_2$ flowing therethrough for increasing the nucleation of the $CO_2$ snow within the downstream section.

The throat, upstream and downstream sections of the nozzle, as well as the sections of the nozzle defining the turbulence cavity, may be silicon micromachined surfaces.

BRIEF DESCRIPTION OF THE DRAWINGS

Other objects, features and advantages of the present invention will be apparent from a study of the written descriptions and the drawings in which.

DESCRIPTION OF THE PREFERRED EMBODIMENT AND METHOD

Figure 1:
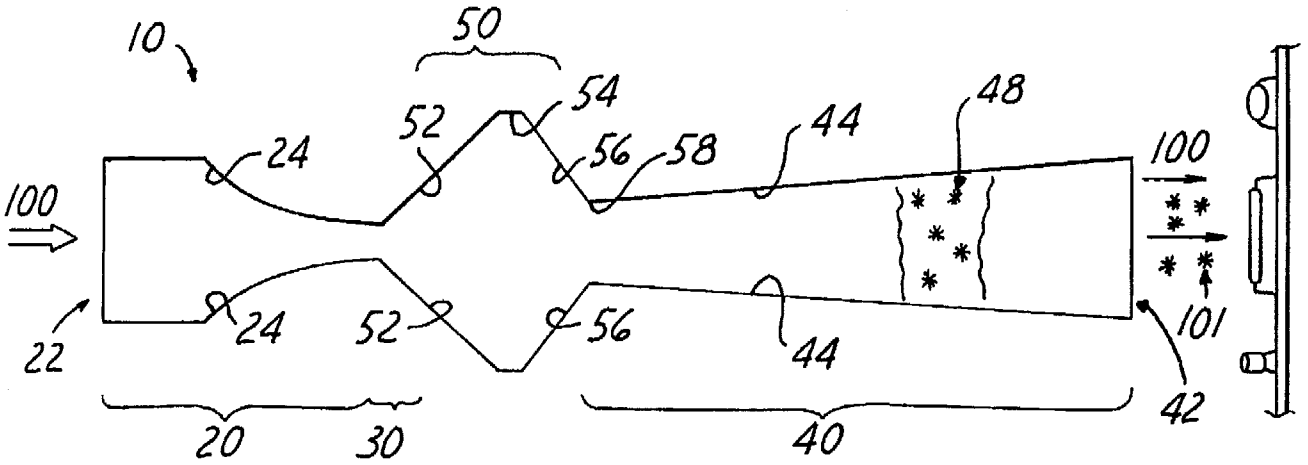
FIG. 1 is a functional diagram of the silicon micromachined nozzle in accordance the present invention. This diagram is not drawn to scale, and reference should be made to Table 1 for the exact dimensions of the preferred embodiment.

A simplified, sectioned view of a nozzle in accordance with the present invention is illustrated generally as 10 in FIG. 1. The nozzle 10 includes an upstream section 20, a downstream section 40 and a throat section 30. An open end 22 receives therein carbon dioxide gas 100 from a storage container (not shown) under pressure ranging from about 400 psi to 900 psi, with about 800 psi being preferred. The $CO_2$ gas could be supplied with an input temperature of from between −40 degrees F. and +90 degrees F., but any substantial deviations from the design input temperature of +70 degrees F. could require design changes in the nozzle for optimum performance. The $CO_2$ gas may be cooled before entering the open end 22 of the nozzle 10 if additional conversion efficiency in making snow is required. While $CO_2$ gas is specified in the preferred embodiment, the invention also will perform with liquid $CO_2$. Of course, modifications to the design can be made to optimize $CO_2$ snow production using the liquid $CO_2$, but gaseous $CO_2$ is preferred because of ease of handling and lower cost. Other disadvantages of using liquid $CO_2$ include longer start-up times and frosting of the nozzle exit.

The contour or curvature of the inside surface 24 of the upstream section 20 of the nozzle is designed according to the matched-cubic design procedure described by Thomas Morel in "Design of 2-D Wind Tunnel Contractions", Journal of Fluids Engineering, 1977, vol. 99. According to this design the gaseous $CO_2$ flows at subsonic speeds of approximately 20 to 1000 feet per second as it approaches the throat section 30.

The downstream section 40 includes an open end 42 for exhausting the carbon dioxide gas 100 and the resulting $CO_2$ snow 101 toward a workpiece 200 under ambient exhaust pressures.

Figure 3:
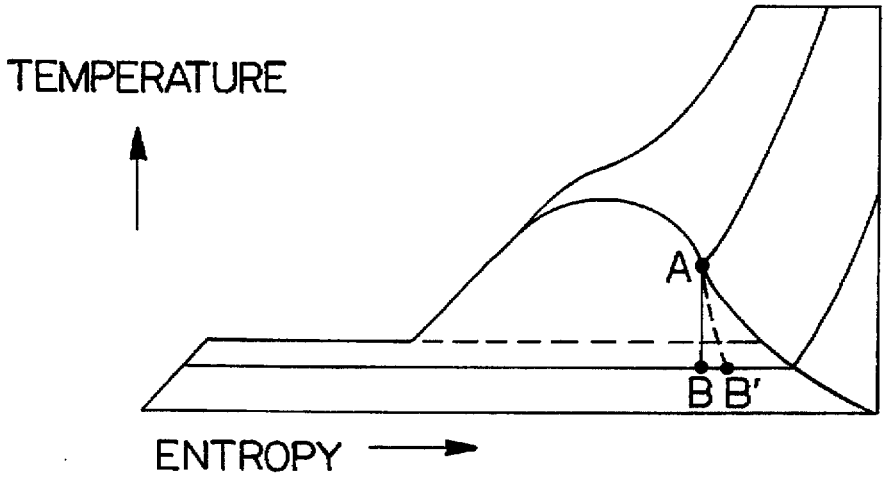
FIG. 3 is a simplified diagram of the thermodynamic properties of $CO_2$ showing the constant entropy lines as a function of temperature and pressure.

The contour of the interior surface 34 of the throat section 30 is designed to cause an adiabatic expansion of the $CO_2$ gas passing therethrough. The $CO_2$ gas expands in accordance with the temperature-entropy chart illustrated in FIG. 3, generally moving along the constant entropy line A–B. When pressure is reduced to point B, the $CO_2$ gas will convert at least partially to snow. Due to the recirculating flow of the $CO_2$ within the turbulence cavity, some frictional losses are generated, thereby making the conversion process more adiabatic than isentropic. This effect causes point B on the process diagram to shift slightly to point B' as shown by the dotted line in FIG. 3.

This conversion to $CO_2$ snow is designed to occur near the exhaust port 42 of the downstream section 40 of the nozzle so that additional kinetic energy will not be required to accelerate the snow 101 toward the workpiece. The location of the conversion occurs between the exit of the turbulence cavity 50 and the exhaust port 42. The preferred embodiment is designed for a Mach 2.0 exit speed for the $CO_2$ gas and the snow. The conversion to snow will not occur in the throat section 30 or in the turbulence cavity section 50 of the nozzle 10 because the speed of the $CO_2$ gas traveling therethrough is designed only to be approximately 1.0 Mach, which results in a pressure above that required to cause snow to occur.

As defined herein, snow is considered to be small, solid phase particles of $CO_2$, produced either directly or from intermediate liquid $CO_2$ droplets, having mean diameters of approximately 20 micrometers and exhibiting a more or less uniform distribution in particle size. The term Mach is defined as the speed of sound within a gas at a given pressure and temperature.

The contours of the inside surfaces 34 and 44 are designed such that at supersonic flow rates the gaseous $CO_2$ flows directly out of the exhaust port 42 while maintaining a generally uniform flow-distribution at the nozzle exhaust 42. This configuration results in the intended collinear exhaust flow.

Because of the low dispersion design of the throat 30 and the downstream section 40 of the nozzle 10, the exhaust pattern is maintained and focused at about the same size as, or perhaps slightly smaller than, the cross-section of the nozzle exit 42 (approximately 1500 to 3250 microns in the preferred embodiment) even at 1 to 5 centimeters from the nozzle exit 42. The precise exhaust pattern also provides a generally even distribution of $CO_2$ snow throughout the exhaust gasses.

The present invention also includes, as a part of the throat section 30, a mid-stream turbulence cavity section 50 that is sized and shaped in order to enhance the nucleation of small $CO_2$ liquid particles into larger $CO_2$ liquid particles before passing into the snow zone 48 of the downstream section 40 where the liquid particles encounter the phase change from $CO_2$ liquid into $CO_2$ snow. The snow zone 48 is located generally in the downstream half of the downstream section 40, but in any event is spaced downstream from the turbulence cavity 50 by a factor of generally two to five times the height of the exit aperture of the turbulence cavity 50.

The turbulence cavity 50 is defined by a diverging surface 52 which is coupled to the interior surface 34 of the throat section 32 at a point after the throat begins to diverge from its narrowest cross-section. The angle at which the diverging surface 52 departs from the center line of the nozzle 10 is determined such that the mixture of $CO_2$ gas and $CO_2$ liquid particles emerging downstream from the narrowest cross-section of the throat section 30 cannot maintain contact with the diverging surface 52. This fluid flow divergence causes a turbulence within the turbulence cavity 50 that will be described subsequently.

A transitionary surface 54 is oriented generally parallel to the flow axis of the $CO_2$ passing through the nozzle, and this surface defines the outer limits of the turbulent travel of the $CO_2$ flowing within the cavity 50. The transitionary surface 54 then is coupled to the converging surface 56, which in turn intersects with the inner surface 44 of the downstream or horn section 40 of the nozzle 10. The angle of the converging surface 56 is designed to enhance the turbulent flow of the $CO_2$ within the cavity 50 after it exits the narrowest cross-section of the throat section 30 and before it enters the downstream section 40. This angle is determined empirically so as to cause a circular or vortex motion in the turbulence within the mid-stream cavity.

Figure 1A:
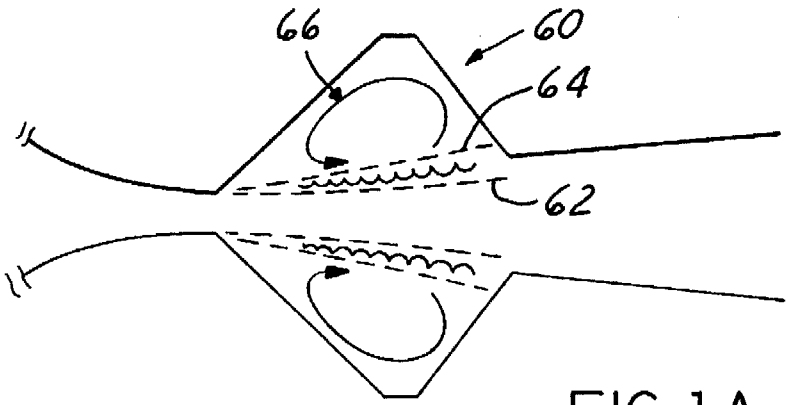
FIG. 1A is an enlarged diagram of the turbulence cavity and the induced $CO_2$ turbulence therein from FIG. 1.

FIG. 1A, which is an enlarged view of the turbulence cavity 50 shown in FIG. 1, illustrates the turbulent flow 60 of the $CO_2$ as it exits the converging-diverging throat section 30 of the nozzle, and before it enters the downstream section 40. Reference numeral 62 indicates the inner shear boundary of the high speed $CO_2$ gas as it flows directly from the narrowest section of the throat 30 and proceeds directly into the downstream section 40. Note that there is relatively high turbulence in the volume defined between the upper and lower inner shear boundary lines 62 of the turbulence cavity 50.

Reference numeral 64 is used to indicate the outer shear boundary line. The $CO_2$ turbulence between the inner shear boundary line 62 and the adjacent outer shear boundary line 64 is schematically shown as a coiled line to indicate the shear turbulence created adjacent to the main flow of the $CO_2$ mixtured created by the shape of the cavity 50.

Reference numeral 66 is used to indicate a vortex turbulence that is substantially contained within the boundaries of the turbulence cavity 50, as defined by the converging surface 56, the transitionary surface 54 and the diverging surface 52. The $CO_2$ gas within the vortex turbulence 66 has a higher level of turbulence than the $CO_2$ gas between the inner and outer shear boundaries 62 and 64.

The effective turbulence defined between the inner and outer shear boundary layers 62 and 64 as well as the vortex turbulence 66 within the turbulence cavity 50 define a region of enhance agglomeration for the liquid $CO_2$ droplets flowing therethrough. This region provides additional nucleation time for the $CO_2$ gas to precipitate into the intermediate liquid droplets and to allow the flow mixture to reach an equilibrium state. Since such turbulence enhances the agglomeration of the $CO_2$ liquid and solid particles into larger particles, the resulting larger particles have an enhanced precipitation propensity that increases the conversion efficiency of the enlarged $CO_2$ liquid particles as they flow through the snow zone 48 in FIG. 1. The turbulence cavity 50 also shortens the start-up time required for the initial formation of the $CO_2$ snow following application of pressurized $CO_2$ gas at the upstream section of the nozzle.

When the turbulence cavity 50 is eliminated during testing and the $CO_2$ flows directly through from the converging-diverging nozzle section and into the downstream horn section 40, a reduced level of $CO_2$ snow is produced at the exhaust 42 in comparison with the use of the turbulence cavity 50. While it is difficult to quantify the difference in the levels of $CO_2$ snow produced with and without the turbulence cavity 50, it is apparent that the $CO_2$ snow produced through the use of the turbulence cavity 50 is sufficient to clean hardened flux from a printed circuit board, whereas the $CO_2$ snow resulting from a nozzle 10 not having the turbulence cavity 50 is incapable of removing the same flux within a similar period of time.

With continuing reference to FIG. 1, reference numeral 58 defines the angular intersection between the converging surface 56 of the turbulence cavity 50 and the interior surface 44 of the downstream section 40. The sweep of this intersection around the circumference of the interior section of the downstream section 40 defines a collection opening 58 which is both the exit from the turbulence cavity 50 and the entrance to the downstream section 40. The effective area of the collection opening 58 is designed to be approximately 1 to 3 times the effective area of the narrowest section of the throat section 30, shown as reference numeral 34. The minimum ratio of length, as measured along the direction of flow, to width of the turbulence cavity is approximately 1, with the preferred ratio of length to width being approximately 7.

Figure 2:
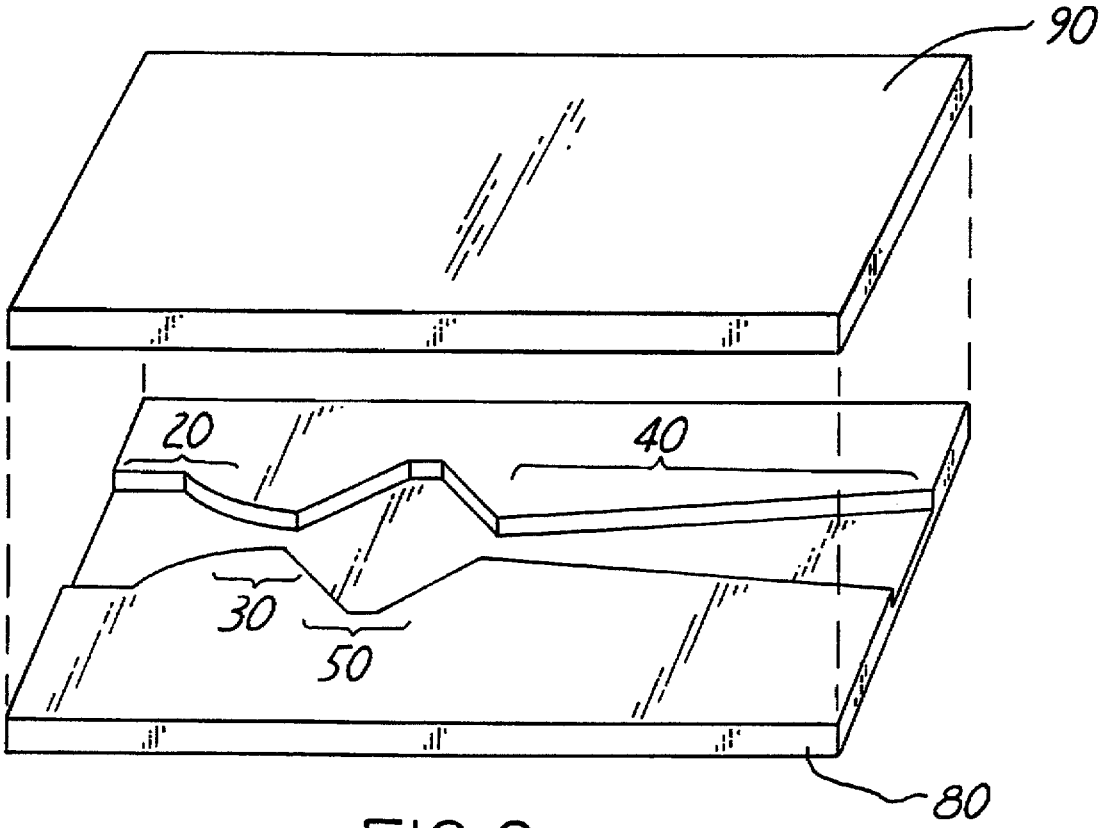
FIG. 2 is an exploded perspective view of the silicon micromachined nozzle as it is would be assembled.

As may be observed from the foregoing discussion, the many advantages of the present invention are due in large part to the precise design and dimensions of the internal contoured surfaces 24, 34, 52 54, 56 and 44 of the nozzle 10, which are obtained through the use of silicon micromachine processing. However, the nozzle may be manufactured from other materials, such as glass, metal, plastic, etc., that are capable of being accurately formed into the specified contours. FIG. 2 illustrates a perspective view of a silicon substrate 80 into which the contours of sections 20, 30, 40 and 50 of the nozzle 10 were etched using well known photolithographic processing and chemical etching technologies. In the first preferred embodiment, the throat section 30 is etched approximately 400 micrometers down into the substrate 80, and then another planar substrate 90 is placed upon and fused (fusion bonding) to the planar substrate in order to seal the nozzle 10.

The precise control of the shape and size of the nozzle 10 allows the system to be sized to create a rectangular snow pattern of approximately 400 by 2500 microns. This allows the nozzle to be used for cleaning small areas of a printed circuit board that has been fouled by flux, solder or other contaminants during manufacturing or repair operations.

An additional advantage of focusing the snow 101 onto such a small footprint is that any electrostatic charge generated by tribo-electric action of the snow and the gaseous $CO_2$ against the circuit board, or other workpiece being cleaned, is proportional to the size of the exhaust pattern. Therefore, as the snow footprint is minimized in size, the resulting electrostatic charge can be minimized so as to be easily dissipated by the workpiece or by using other charge dissipation techniques, without causing damage to sensitive electronic components mounted thereon. This advantage makes the system especially well suited for cleaning and repairing fully populated printed circuit boards. Because the nozzle is very small, it can be housed in a hand-held, portable cleaning device capable of being used in a variety of cleaning applications and locations.

BEST MODE EXAMPLE

The contour dimensions of the presently preferred embodiment of the silicon micromachined nozzle 10 are listed in Table 1 attached hereto. The X dimension is measured in microns along the central flow axis of the nozzle, while the Y dimension is measured from the central flow axis to the contoured surface of the nozzle wall. The rectangular throat section 30 of the nozzle 10 measures approximatley 500 microns from one contour surface to the other, or 250 micrometers from the centerline to the contour surface. As previously discussed, the converging-diverging throat section 30 of the nozzle 10 is approximately 400 microns in depth.

Pure carbon dioxide gas at approximately 70 degrees F. and 800 psi is coupled to the upstream end 20 of the nozzle 10. The $CO_2$ at the output from the downstream section 40 of the nozzle 10 has a temperature of about −150 degrees F. and a velocity of approximately 1500 feet per second. The output $CO_2$ includes approximately 10–15% by mass of solid $CO_2$ snow, which has a mean particle size of approximately 20 microns. The size of the exhaust footprint is approximately 400 by 2500 microns, and the nozzle is designed to be used approximately 2 centimeters from the workpiece. Angles of attack of the $CO_2$ snow 101 against the workpiece 200 can vary from 0 degrees to 90 degrees.

The exact contour of the nozzle may be more accurately defined according to Table 1 as follows:

TABLE 1

| x (micron) | y (micron) |
|---|---|
| 0 | 1250 |
| 2500 | 1250 |
| 3000 | 829 |
| 3500 | 546.5 |
| 4000 | 375 |
| 4500 | 287 |
| 5000 | 254.5 |
| 5500 | 250 |
| 7500 | 2000 |
| 8000 | 2000 |
| 9000 | 600 |
| 18500 | 1250 |

While the present invention has been particularly described in terms of preferred embodiment thereof, it will be understood that numerous variations of the invention are within the skill of the art and yet are within the teachings of the technology and the invention herein. Accordingly, the present invention is to be broadly construed and limited only by the scope and spirit of the following claims.

I claim:

1. An apparatus for cleaning a workpiece with abrasive $CO_2$ snow, comprising a nozzle for creating and expelling the $CO_2$ snow, comprising:

an upstream section for receiving $CO_2$ gas at a first pressure, said upstream section having a first contour optimized for subsonic flow of the $CO_2$, a downstream section for directing the flow of the $CO_2$ and the $CO_2$ snow toward the workpiece, said downstream section having a second contour for developing supersonic flow of the $CO_2$, a throat section, coupled between and for cooperating with said upstream and downstream sections, for changing at least a portion of the $CO_2$ flowing therethrough from the gaseous phase, into $CO_2$ snow within said downstream section at a speed of at least Mach 1.1, and a turbulence cavity section, interposed between said throat section and said downstream section, comprising surfaces for introducing both shear and vortex turbulence within the flow of gaseous $CO_2$ flowing adjacent thereto and for increasing the nucleation of the $CO_2$ snow within said downstream section, whereby the additional turbulence introduced into the $CO_2$ flowing within said turbulence cavity improves the conversion efficiency of the $CO_2$ gas into $CO_2$ snow particles.

2. The apparatus as described in claim 1 wherein said shear turbulence and said vortex turbulence combine to increase the agglomeration efficiency of intermediate $CO_2$ liquid droplets produced prior to the phase change into $CO_2$ snow in said downstream section.

3. The apparatus as described in claim 1 wherein a maximum effective cross sectional area defined by said turbulence cavity is at least 2 times the minimum effective cross sectional area of said throat section, thereby enhancing both said shear and vortex turbulence induced within said turbulence cavity.

4. The apparatus as described in claim 1 wherein said turbulence cavity is defined by a ratio of length, as measured along the direction of flow of the $CO_2$ gas, to width of said throat section being greater than 1.

5. The apparatus as described in claim 1 wherein said throat, upstream, downstream and turbulence cavity sections of said nozzle comprise silicon micromachined surfaces.

6. The apparatus as described in claim 1 wherein said second contour is optimized for focusing the flow of the $CO_2$ snow as it exits the nozzle.

7. The apparatus as described in claim 6 wherein said second contour is optimized to achieve a parallel flow of the $CO_2$ gas and snow exiting said downstream section, thereby focusing the snow in a small footprint for abrasive application to the workpiece.

8. The apparatus as described in claim 1 wherein the speed of the snow in said downstream section is at least Mach 1.1.

9. The apparatus as described in claim 1 wherein said first pressure is in the range of 400 to 900 psi.

10. The apparatus as described in claim 1 wherein said throat section is spaced between converging and diverging sections for compressing and then expanding the $CO_2$ gas as it passes therethrough.

11. The apparatus as described in claim 1 wherein said throat and downstream sections of said nozzle produce a mix of exhausted $CO_2$ gas and snow in the approximate ratio of 10% to about 15% by mass.

12. The apparatus as described in claim 1 wherein said throat section and said turbulence cavity section cause the conversion of the $CO_2$ gas into $CO_2$ snow in a snow zone defined within said downstream section and operatively spaced from said turbulence cavity.

13. A method for cleaning a workpiece with abrasive $CO_2$ snow, comprising:

(a) receiving $CO_2$ in a gaseous form at a first pressure in an upstream section of a nozzle having a first contour optimized for subsonic flow of the $CO_2$, (b) passing the $CO_2$ through a throat section of the nozzle for changing the $CO_2$ from the gaseous phase to a $CO_2$ mixture of gas and intermediate liquid droplets, (c) passing the $CO_2$ mixture through a turbulence cavity for creating turbulence for enhancing the subsequent nucleation of the intermediate $CO_2$ liquid droplets as they change phase into $CO_2$ in a downstream snow zone, and (d) passing the $CO_2$ mixture through a downstream section of the nozzle defining the snow zone therein and having a second contour for directing the flow of the $CO_2$ and the snow toward the workpiece at a speed greater than Mach 1.1, whereby the efficiency of conversion of the $CO_2$ gas to $CO_2$ snow is enhanced by the turbulence with the turbulence cavity.

14. The method as described in claim 13 wherein step (c) further includes the substep of inducing both shear and vortex turbulence within the turbulence cavity, thereby increasing the subsequent conversion efficiency of $CO_2$ gas to $CO_2$ snow in the snow zone.

15. The method as described in claim 14 wherein step (c) further includes the substep of orienting and sizing the turbulence cavity for increasing boundary layer shear turbulence buildup downstream from the throat as the $CO_2$ passes therethrough, thereby improving the conversion efficiency of $CO_2$ gas to $CO_2$ liquid and $CO_2$ snow.

16. The method as described in claim 14 wherein step (c) further includes the substep of orienting and sizing the turbulence cavity for increasing vortex turbulence within the turbulence cavity as the $CO_2$ passes therethrough, thereby improving the subsequent conversion efficiency of $CO_2$ gas to $CO_2$ liquid and $CO_2$ snow.

17. The method as described in claim 14 further including the step of generating a mix of exhausted $CO_2$ gas and snow in the approximate ratio of 5 to 1 by mass.

18. The method as described in claim 13 wherein step (d) further includes the step of creating a generally parallel flow of $CO_2$ gas and $CO_2$ snow exiting the downstream section, thereby focusing the snow into a small footprint for abrasive application to the workpiece.

19. The method as described in claim 13 further including the step of accelerating the $CO_2$ mixture to a speed of at least Mach 1.1 in the downstream section.

20. An apparatus for cleaning a workpiece with abrasive $CO_2$ snow, comprising a nozzle for creating and expelling the $CO_2$ snow, comprising:

an upstream section for receiving $CO_2$ gas at a first pressure, said upstream section having a first contour optimized for subsonic flow of the $CO_2$, a downstream section for directing the flow of the $CO_2$ and the $CO_2$ snow toward the workpiece, said downstream section having a second contour for developing supersonic flow of the $CO_2$, a throat section, coupled between and for cooperating with said upstream and downstream sections, for changing at least a portion of the $CO_2$ flowing therethrough from the gaseous phase, into $CO_2$ snow within said downstream section at a speed of at least Mach 1.1, and a turbulence cavity section, interposed between said throat section and said downstream section, comprising surfaces positioned for introducing additional turbulence within the flow of gaseous $CO_2$ flowing through said turbulence cavity section and for increasing the nucleation of the $CO_2$ snow within said downstream section, whereby the additional turbulence introduced into the $CO_2$ flowing within said turbulence cavity improves the conversion efficiency of the $CO_2$ gas into $CO_2$ snow particles.

* * * * *